US009269314B2

(12) United States Patent
Harada et al.

(10) Patent No.: US 9,269,314 B2
(45) Date of Patent: Feb. 23, 2016

(54) DISPLAY DRIVER

(71) Applicant: Synaptics Display Devices GK, Tokyo (JP)

(72) Inventors: Masashige Harada, Tokyo (JP); Kunihiko Tani, Tokyo (JP); Sosuke Suji, Tokyo (JP)

(73) Assignee: Synaptics Display Devices GK, Tokyo (JP)

( * ) Notice: Subject to any disclaimer, the term of this patent is extended or adjusted under 35 U.S.C. 154(b) by 0 days.

(21) Appl. No.: 14/246,048

(22) Filed: Apr. 5, 2014

(65) Prior Publication Data

US 2014/0313183 A1 Oct. 23, 2014

(30) Foreign Application Priority Data

Apr. 18, 2013 (JP) ..... 2013-087225

(51) Int. Cl.
*G09G 1/00* (2006.01)
*G09G 3/36* (2006.01)

(52) U.S. Cl.
CPC ..... *G09G 3/3611* (2013.01); *G09G 2330/025* (2013.01); *G09G 2360/122* (2013.01); *G09G 2360/18* (2013.01)

(58) Field of Classification Search
CPC . G09G 3/36; G09G 2330/021; G09G 3/3648; G06F 3/041
See application file for complete search history.

(56) References Cited

U.S. PATENT DOCUMENTS

2007/0057896 A1* 3/2007 Natori et al. ..... 345/98
2008/0186266 A1* 8/2008 Takahashi ..... 345/87

FOREIGN PATENT DOCUMENTS

JP 2008-191442 A 8/2008

* cited by examiner

*Primary Examiner* — Michael Faragalla
(74) *Attorney, Agent, or Firm* — Miles & Stockbridge P.C.; Eric G. King

(57) ABSTRACT

The display driver includes an image memory which is configured by including a plurality of memory mats, a plurality of power supply switches which can perform an ON and OFF control of power supply to each of the plurality of memory mats, and a control circuit which turns on or off the power supply switches. The control circuit turns on the plurality of power supply switches in such a manner that the power supply to the memory mat to which the image data is written at an initial time, among the plurality of memory mats, becomes stable earlier than the power supply to the other memory mats.

20 Claims, 8 Drawing Sheets

DISPLAY DRIVER

CROSS-REFERENCE TO RELATED APPLICATIONS

The present application claims priority from Japanese application JP 2013-087225 filed on Apr. 18, 2013, the content of which is hereby incorporated by reference into this application.

BACKGROUND

1. Field of the Invention

The present invention relates to a display driver, and particularly to a display driver which can be appropriately used in a display driver Integrated Circuit (IC) with a built-in image memory.

2. Background Art

In a display driver, on which a Static Random Access Memory (SRAM) that is an image memory is mounted, for example, a Liquid Crystal Display (LCD) driver, and in a product to which a process rule using a process technology equal to or greater than 130 nm is applied, an off-leakage of a Metal Oxide Semiconductor (MOS) transistor is small enough, and a leakage current flowing through the whole SRAM is small enough compared to operation power of the LCD driver, and thus influence on a consumption current of the whole LCD driver is small to a negligible degree. Recently, as the number of pixels of the LCD panel is increased, memory capacity of the SRAM mounted on the LCD driver is increased in class by several tens of Mbit, and process shrinking is underway for chip size reduction. For example, in case that a process moves from a 130 nm process to a 90 nm process, a power supply voltage is lowered from 1.5 V to 1.3 V in relation to a breakdown voltage of the MOS transistor, but at the same time, the MOS transistor performance is maintained, and thus a threshold voltage (Vth) is also required to decrease. As a result, a problem happens that the off-leakage current of the SRAM increases and the consumption current of the whole LCD driver increases to a degree that cannot be ignored.

In JP-A-2008-191442, a technology is disclosed which decreases the off-leakage current of a memory mounted on the display driver IC and makes stable a normal operation of the memory. Depending on which operation mode of a normal operation mode and a stand-by mode is selected for the display driver IC, an ON and OFF control of a switch transistor connected to a power supply of the memory is performed, power supply delivery to an unnecessary portion is cut off, and the off-leakage current is reduced. In the switch transistor, the power supply of a voltage which is higher to a degree where a voltage drop generated by the switch transistor can be compensated for, is connected thereto, and thereby the power supply of the memory itself can be maintained to a high value, and the normal operation of the memory can become stable.

SUMMARY

The present inventor has studied JP-A-2008-191442 and has found the following new problems.

As a function of an LCD driver, there are a Command RAM Mode and a Video Through Mode. In the Command RAM Mode, image data from a host processor is retained in a SRAM which functions as an image memory built-in the LCD driver, and in a case where the image data is a still image which is not changed, the data retained in the SRAM continues to be displayed on a LCD panel. In a Video Through Mode, the image data from the host processor continues to be displayed sequentially on the LCD panel. In a case of the Command RAM Mode, the image data is required to continue to be retained, and thus power has to be supplied to the SRAM, but in a case of the Video Through Mode, the image data is not required to be retained in the SRAM, and thus it is possible to stop power supply to the SRAM for off-leakage reduction.

When a transition from the Video Through Mode to the Command RAM Mode is performed, it is necessary to restart the power supply to the image memory to which the power supply is stopped. At this time, a large current which is called inrush current flows through the image memory. As studied by the inventor, when the transition from the Video Through Mode to the Command RAM Mode is performed, during an operation in the Video Through Mode and a normal operation of the LCD driver, influence of a noise caused by the inrush current on the operation cannot be ignored. In particular, as the number of pixels of a recent display panel is increased, a storage capacity of the image memory also tends to be on a large scale, and the inrush current is further increased together with process shrink, and thus it is expected that the problem will be more serious.

As described above, the inventor has studied and found that in case that an ON and OFF control of the power supply to the image memory in the display driver is performed, it is necessary to suppress the inrush current.

In the display driver IC disclosed in JP-A-2008-191442, the ON and OFF control of a switch transistor is performed based on an operation mode, but in case that the power supply to the memory is started when a transition from an operation mode without the memory being used to an operation mode using the memory is performed, the inrush current flowing through the memory is not considered.

In addition, the inventor has studied and found that it is not necessarily appropriate or not sufficient to suppress the inrush current by reducing, for example, a switch transistor size or the like, thereby slowing down a start-up of the power supply to the image memory. When the operation mode transitions, a command which designates the operation mode is input, and until data to be written to the image memory is input, a start of stable power supply to the image memory is required, and a delay of image data writing to the memory is not allowed.

Means for solving the problems will be described hereinafter, but other problems and novel features will be apparent from the description of the present specification and the accompanying drawings.

A display driver according to the invention includes an image memory which is configured to include a plurality of memory mats, a plurality of power supply switches which can perform an ON and OFF control of power supply to each of the plurality of memory mats, and a control circuit which performs an ON and OFF control of the power supply switches. The control circuit performs a control which turns on the plurality of power supply switches, in such a manner that the power supply to the memory mat to which image data is written at an initial time, among the plurality of memory mats, becomes stable earlier than the power supply to the other memory mats.

A brief description for an effect obtained by the invention is as follows.

That is, even when an off-leakage current of the image memory is reduced by performing the ON and OFF control of the power supply to the image memory, it is possible to suppress to a low value an inrush current occurring when the power supply to the memory is started, without image data writing to the memory being delayed.

DETAILED DESCRIPTION

1. Summary of the Embodiments

Figure 1:
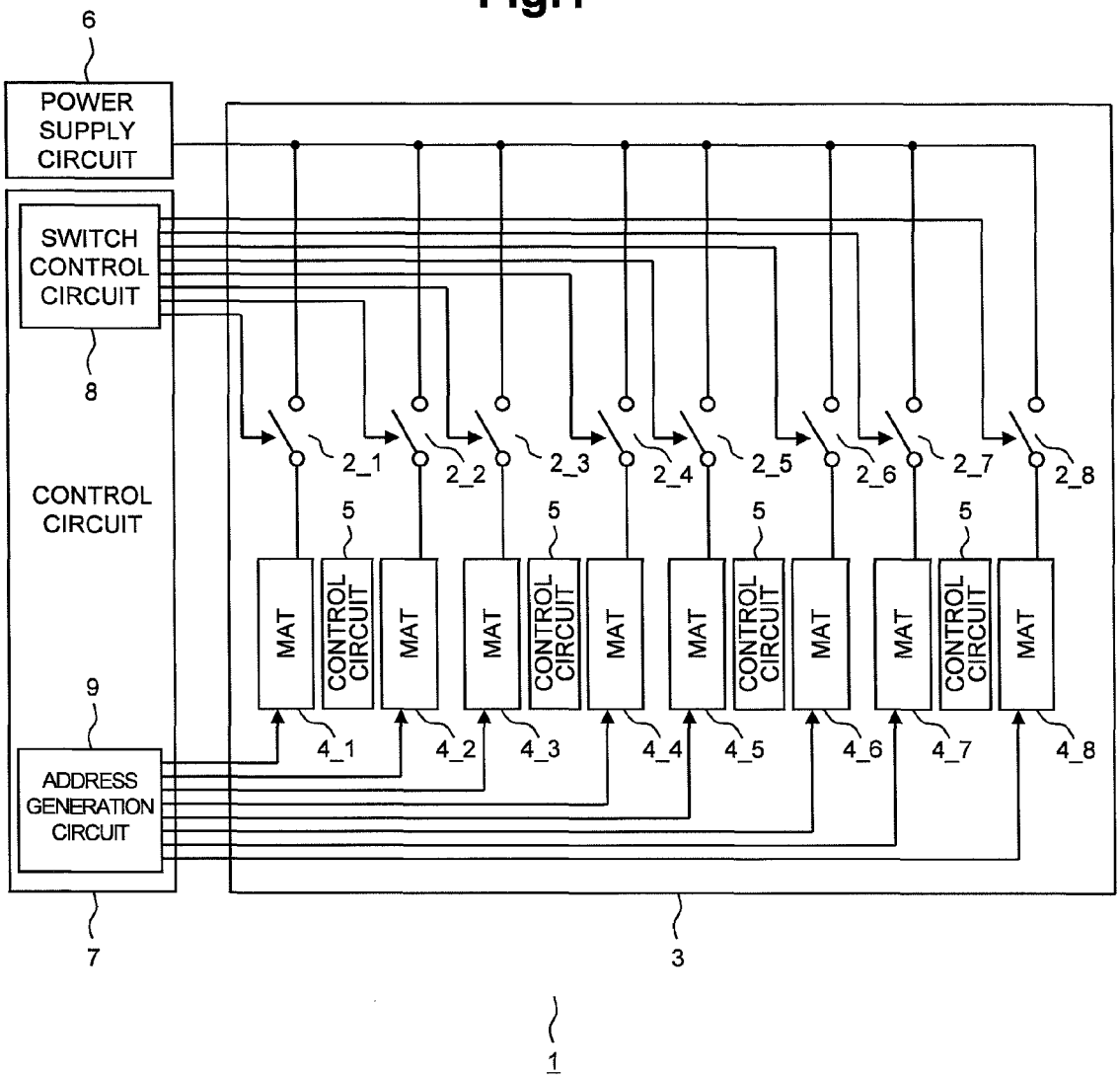
FIG. 1 is a block diagram illustrating essential units of a display driver according to a first embodiment.

First, summary of representative embodiments of the invention disclosed in the application will be described. Reference numerals in drawings in parentheses referred to in description of the summary of the representative embodiments just denote components included in the concept of the components to which the reference numerals are designated.

[1] <Distribution of Inrush Current when Starting Power Supply to Memory>

A display driver (1) according to a representative embodiment disclosed in the application includes a driver circuit (10), a memory (3), power supply switches (2 and 2_1 to 2_8), and a control circuit (7). The driver circuit (10) can output a driving signal to a display panel (12) which is externally connected to the display driver. The memory (3) includes a plurality of memory mats (4 and 4_1 to 4_8), and can store image data for generating the driving signal. A plurality of power supply switches (2_1 to 2_8) can perform an ON and OFF control of a power supply to each of the plurality of memory mats, and the control circuit (7) can perform the ON and OFF control of the plurality of power supply switches.

The control circuit (7) can perform a control of turning on the plurality of power supply switches such that the power supply to a memory mat to which the image data is written at an initial time, among the plurality of memory mats, becomes stable earlier than the power supply to the other memory mats.

According to this, even when an off-leakage current of an image memory is reduced by performing the ON and OFF control of the power supply to the image memory, it is possible to suppress to a low value an inrush current occurring when the power supply to the memory (3) is started, without image data writing to the memory being delayed.

[2] <Power Supply Switches Connected in Parallel with Each Other with Different Sizes from Each Other>

In section 1, the plurality of power supply switches include first switches (21_1 to 21_3) and second switches (22_1 and 22_3) which are connected to each of the plurality of memory mats. The first switches and the second switches are connected in parallel with each other, and ON-resistance of the first switch is lower than that of the second switch.

The control circuit starts the power supply to the memory mat to which the image data is written at an initial time by turning on the first switch earlier than the second switch, and starts the power supply to the other memory mats by turning on the second switch earlier than the first switch.

According to this, it is possible to suppress to a low value the inrush current occurring when the power supply to the memory is started, without a complicated timing control being performed.

[3] <Switch MOS with Different Sizes from Each Other>

In section 2, the first switches and the second switches are configured by MOSFETs (21_1 to 21_3 and 22_1 to 22_3), and the MOSFET which configures the first switch is larger in a ratio of a gate width to a gate length than the MOSFET which configures the second switch.

According to this, it is possible to simply and correctly set the ON-resistances of the first and second power supply switches.

[4] <Timing Control>

In section 1, the plurality of power supply switches include power supply switches (23_1 to 23_3) which are connected to each of the plurality of memory mats.

The control circuit starts the power supply by turning on the power supply switch connected to the memory mat to which the image data is written at an initial time earlier than the power supply switch connected to the other memory mats.

According to this, it is possible to suppress to a low value the inrush current occurring when the power supply to the memory is started, only by including one power supply switch connected to one memory mat.

[5] <Sequential Turn-on Control>

In section 4, the control circuit starts the power supply by sequentially turning on the power supply switches connected to each of the plurality of memory mats.

According to this, it is possible to suppress to a low value a peak value of the inrush current occurring when the power supply to the memory is started.

[6] <Power Supply Control Based on Command from Host Processor>

In any one of the sections 1 to 5, the control circuit can receive a command supplied from a host processor (11) which is externally connected to the display driver, and perform the ON and OFF control of the plurality of power supply switches based on the received command.

According to this, it is possible for the display driver to perform an appropriate power supply control without a special setting.

[7] <Command RAM Mode and Video Through Mode>

In section 6, the control circuit performs a control of starting power supply to the memory when the command is a command which designates a Command RAM Mode, and performs a control of cutting off the power supply to the memory when the command is a command which designates a Video Through Mode.

According to this, the power is supplied to the memory in the Command RAM Mode which displays a still image stored in the memory, and the power supply to the memory is cut off in the Video Through Mode which displays a moving image without using the memory, and thereby it is possible to suppress an unnecessary off-leakage current of the memory.

[8] <Interpretation of Address Designated in Command RAM Mode>

In section 7, when the command is the command which designates the Command RAM Mode, the control circuit has a function of specifying the memory mat to which the image data is written at an initial time, based on a start address and an end address, which are designated according to the command, of the memory.

According to this, it is possible for the display driver to specify the memory mat to which the image data is written at an initial time, without the special setting.

[9] <Register for Designating Size of Display Panel Externally Connected to the Display Panel>

In any one of the sections 1 to 8, the control circuit includes a register (13) which can designate a size of the display panel externally connected to the display driver. The display driver can perform a control of performing no power supply to a portion of the plurality of memory mats, based on a value retained in the register.

According to this, it is possible for the display driver to perform the appropriate power supply control, according to the size of the display panel externally connected to the display driver.

[10] <Distribution of Inrush Current when Starting Power Supply to Memory>

The display driver (1) according to the representative embodiment disclosed in the application includes the driver circuit (10), the memory (3), first power supply switches (21_1 to 21_3), second power supply switches (22_1 to 22_3), and the control circuit (7). The driver circuit (10) can output the driving signal to the display panel (12) which is externally connected to the display driver. The memory (3) includes the plurality of memory mats (4_1 to 4_3), and can store the image data for generating the driving signal. The first power supply switches (21_1 to 21_3) and the second power supply switches (22_1 to 22_3) are connected in parallel with each other, and connected to each memory mat which configures the plurality of memory mats. Each of the first and second power supply switches can perform the ON and OFF control of the power supply to the memory mats. The first power supply switch has a lower ON-resistance than that of the second power supply switch. The control circuit (7) can perform the ON and OFF control over each of the plurality of first and second power supply switches.

The control circuit can perform a control which turns on the first power supply switch earlier than the second power supply switch with respect to at least one of the plurality of memory mats, and turns on the second power supply switch earlier than the first power supply switch with respect to the other memory mats.

According to this, even when the off-leakage current of the image memory is reduced by the ON and OFF control of the power supply to the image memory, it is possible to suppress to a low value the inrush current occurring when the power supply to the memory (3) is started, without the image data writing to the memory being delayed, and without a complicated timing control being performed.

[11] <Switch MOS with Different Sizes from Each Other>

In section 10, the first power supply switches and the second power supply switches are configured to have MOSFETs (21_1 to 21_3 and 22_1 to 22_3), and the MOSFET which configures the first power supply switch is larger in the ratio of the gate width to the gate length than the MOSFET which configures the second power supply switch.

According to this, it is possible to simply and correctly set the ON-resistances of the first and second power supply switches.

[12] <Power Supply Control Based on Command from Host Processor>

In section 10, the control circuit can receive the command supplied from the host processor (11) which is externally connected to the display driver, and perform the ON and OFF control of the plurality of first and second power supply switches based on the received command.

According to this, it is possible for the display driver to perform the appropriate power supply control without the special setting.

[13] <Command RAM Mode and Video Through Mode>

In section 12, the control circuit performs the control of starting the power supply to the memory when the command is a command which designates the Command RAM Mode, and performs the control of cutting off the power supply to the memory when the command is a command which designates the Video Through Mode.

According to this, the power supply is supplied to the memory in the Command RAM Mode which displays the still image stored in the memory, and the power supply to the memory is cut off in the Video Through Mode which displays the moving image without using the memory, and thereby it is possible to suppress the unnecessary off-leakage current of the memory.

[14] <Interpretation of Address Designated in Command RAM Mode>

In section 13, when the command is the command which designates the Command RAM Mode, the control circuit has a function of specifying the memory mat that is a target of the control which turns on the first power supply switch earlier than the second power supply switch, based on the start address and the end address, which are designated according to the command, of the memory.

According to this, it is possible for the display driver to specify the memory mat to which the image data is written at an initial time, without the special setting.

[15] <Data Retention Performed by Image Memory>

In section 12, the control circuit performs a control which starts the power supply to the memory, when the command is the command which designates the Command RAM Mode, and performs a control which maintains the power supply to the memory to a low leakage current, when the command is the command which designates the Video Through Mode.

According to this, it is possible for the display driver to suppress the leakage current to a low value and to retain the image data in the image memory.

[16] <Distribution Performed by Timing Control of Inrush Current when Starting Power Supply to Memory>

The display driver (1) according to the representative embodiment disclosed in the application includes the driver circuit (10), the memory (3), the power supply switches (2 and 23_1 to 23_3), and the control circuit (7). The driver circuit (10) can output the driving signal to the display panel (12) which is externally connected to the display driver. The memory (3) includes the plurality of memory mats (4_1 to 4_3), and can store the image data for generating the driving signal. The power supply switches (2 and 23_1 to 23_3) are connected to each of the plurality of memory mats, and can perform the ON and OFF control of the power supply to each of the plurality of memory mats, and thereby the control circuit (7) can perform the ON and OFF controls of the power supply switches.

The control circuit 7 can perform a control which turns on the power supply switches connected to at least one of the plurality of memory mats earlier than the power supply switches connected to the other memory mats.

According to this, even when the off-leakage current of the image memory is reduced by the ON and OFF control of the power supply to the image memory, the image data writing to the memory is not delayed, and in addition, by connecting only one power supply switch to one memory mat, it is possible to suppress to a low value the inrush current occurring when the power supply to the memory (3) is started.

[17] <Sequential ON Control>

In section 16, the control circuit starts the power supply by sequentially turning on the power supply switches connected to each of the plurality of memory mats.

According to this, it is possible to suppress to a lower value the peak value of the inrush current occurring when the power supply to the memory is started.

[18] <Power Supply Control Based on Command from Host Processor>

In section 16, the control circuit can receive the command supplied from the host processor (11) which is externally connected to the display driver, and perform the ON and OFF control of the plurality of power supply switches based on the received command.

According to this, it is possible for the display driver to perform the appropriate power supply control without the special setting.

[19] <Command RAM Mode and Video Through Mode>

In section 18, the control circuit performs the control of starting power supply to the memory when the command is the command which designates the Command RAM Mode, and performs the control of cutting off the power supply to the memory when the command is the command which designates the Video Through Mode.

According to this, the power supply is supplied to the memory in the Command RAM Mode which displays the still image stored in the memory, and the power supply to the memory is cut off in the Video Through Mode which displays the moving image without using the memory, and thereby it is possible to suppress the unnecessary off-leakage current of the memory.

[20] <Interpretation of Address Designated in Command RAM Mode>

In section 19, when the command is the command which designates the Command RAM Mode, the control circuit 7 has a function of specifying the memory mat that is the target of the control which turns on the power supply switch earlier than the other memory mats, based on the start address and the end address, which are designated according to the command, of the memory.

According to this, it is possible for the display driver to specify the memory mat to which the image data is written at an initial time, without the special setting.

2. Further Detailed Description of the Embodiments

Further detailed description of the embodiments will be made.

[First embodiment]

<Distribution of inrush current when starting power supply to memory>

FIG. 1 is a block diagram illustrating essential units of the display driver according to a first embodiment.

Figure 2:
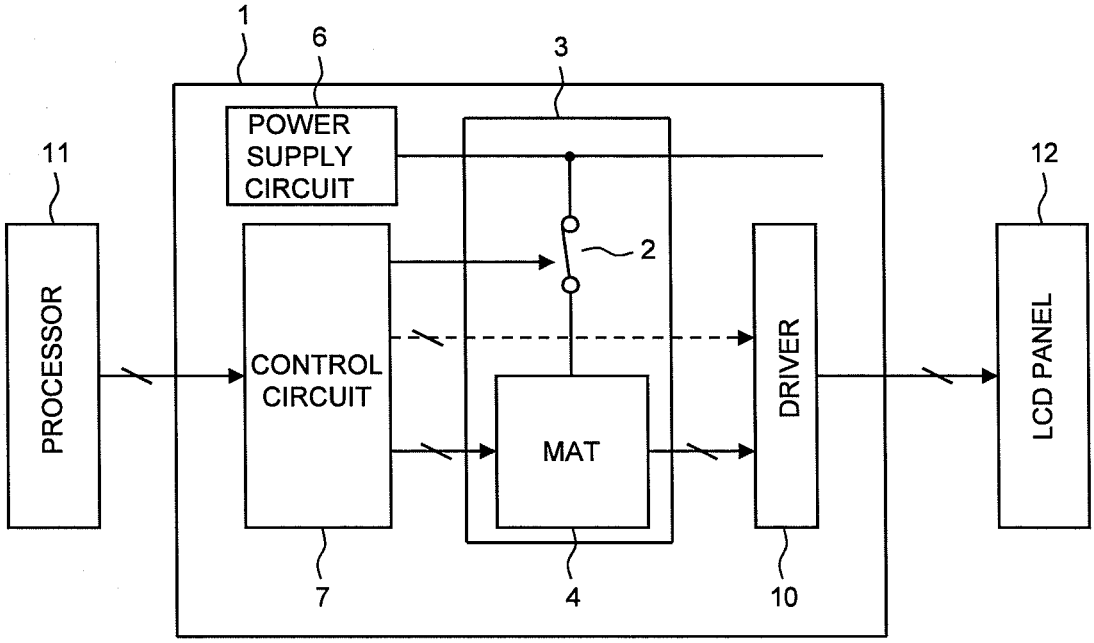
FIG. 2 is an explanatory diagram illustrating an operation in a Command RAM Mode of the display driver according to the first embodiment.
Figure 3:
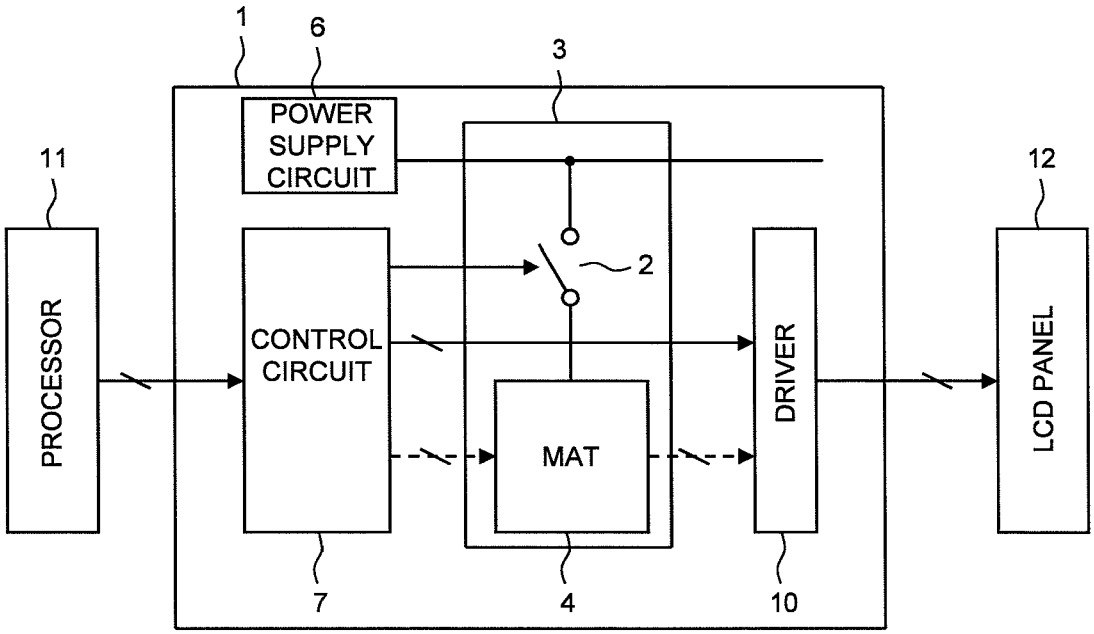
FIG. 3 is an explanatory diagram illustrating an operation in a Video Through Mode of the display driver according to the first embodiment.

The display driver 1 according to the first embodiment includes the driver circuit 10 which is not illustrated, the memory 3, the power supply switches 2_1 to 2_8, and the control circuit 7. The driver circuit 10 outputs the driving signal to the display panel 12 (not illustrated) which is externally connected to the display driver. Although not particularly limited, the display driver 1 is, for example, a liquid crystal display driver (LCD driver), connected to both the host processor 11 and the display panel 12, as illustrated in FIGS. 2 and 3 which are described later, and can display the image on the display panel 12, based on the image data input from the host processor 11. Although not particularly limited, the display driver 1 is formed on a single semiconductor substrate such as silicon, using, for example, a known fabrication technology of a Complementary Metal Oxide Semiconductor Field Effect Transistor (CMOSFET) semiconductor integrated circuit.

The memory 3 is the image memory, includes the plurality of memory mats 4_1 to 4_8 and the control circuits 5 which control the plurality of memory mats 4_1 to 4_8, and stores the image data for generating the driving signal which drives the display panel 12 under a control of the driver circuit 10. The plurality of power supply switches 2_1 to 2_8 are inserted between the power supply circuit 6 and the power supply of each of the plurality of memory mats 4_1 to 4_8 and connected in series thereto, and can perform the ON and OFF control of the power supply. The control circuit 7 includes an address generation circuit 9 and a switch control circuit 8. The address generation circuit 9 performs a control which writes the input image data to the memory mats 4_1 to 4_8 in a predetermined order, and outputs the read data to the driver circuit 10 in another predetermined order. The switch control circuit 8 performs the ON and OFF control of the plurality of power supply switches 2_1 to 2_8.

The switch control circuit 8 of the control circuit 7 turns on the plurality of power supply switches 2_1 to 2_8, in such a manner that the power supply to the memory mat to which the image data is written at an initial time, among the plurality of memory mats 4_1 to 4_8, becomes stable earlier than the power supply to the other memory mats.

According to this, even when an off-leakage current of the image memory is reduced by performing the ON and OFF control of the power supply to the image memory, it is possible to suppress to a low value an inrush current occurring when the power supply to the memory 3 is started, without image data writing to the memory being delayed.

This principle will be described in detail herein. For example, the display driver IC of the related art disclosed in JP-A-2008-191442 cuts off the power supply when the memory is not used, and restarts the power supply when the memory is used, but the inrush current with respect to the memory in which the power supply is restarted is not considered. When the power supply to all of the plurality of memory mats which configure the memory is simultaneously restarted, the inrush current of the whole memory becomes the product of the inrush current per memory mat and the number of memory mats in which the power supply is restarted, and becomes a current with a large peak value. In contrast, the display driver according to the invention provides the power supply switches 2_1 to 2_8 to each of the plurality of memory mats 4_1 to 4_8 which configure the memory 3, and turns on the plurality of power supply switches 2_1 to 2_8, in such a manner that the power supply to the memory mat to which the image data is written at an initial time, among the plurality of memory mats 4_1 to 4_8, becomes stable earlier than the power supply to the other memory mats. For example, when the image data is written to the memory mat 4_1 at an initial time, the power supply to the memory mat 4_1 is required to be stable before the image data is written. For this reason, it is controlled that the power supply switch 2_1 which supplies the power to the memory mat 4_1 becomes stable earlier than the power supply switches 2_2 to 2_8 which supply the power to the other memory mats 4_2 to 4_8.

More specifically, as described in detail in the second embodiment, the ON-resistance of the power supply switch 2_1 which is turned on at an initial time becomes lower than the ON-resistances of the other power supply switches, and the power supply to the memory mat 4_1 to which the image data is written at an initial time becomes stable earlier than the power supply to the other memory mats 4_2 to 4_8. In addition, as described in detail in the third embodiment, by the timing control, the power supply switch 2_1 supplying the power to the memory mat 4_1 to which the image data is written at an initial time is turned on earlier than the power supply switches 2_2 to 2_8 supplying the power to the other memory mats 4_2 to 4_8. The invention is not limited to the specific example, and may be controlled by any other method, in such a manner that the power supply to the memory mat to which the image data is written at an initial time, among the plurality of memory mats, becomes stable earlier than the power supply to the other memory mats.

In contrast with a normal memory, in the image memory of the display driver, the control circuit 7 designates a sequence of writing image data to the plurality of memory mats using the address generation circuit 9, and thereby a control for starting the power supply to the memory mat to which the image data is written at an initial time is performed earlier than that for the other memory mats. The control circuit 7 can receive a command which is supplied from the host processor 11 externally connected to the display driver, and performs the ON and OFF control of the plurality of power supply switches 2_1 to 2_8 based on the received command.

According to this, it is possible for the display driver 1 to perform the appropriate power supply control without the special setting.

<Command RAM Mode and Video Through Mode>

FIG. 2 is an explanatory diagram illustrating an operation in a Command RAM Mode of a display driver according to a first embodiment. FIG. 3 is an explanatory diagram illustrating an operation in a Video Through Mode of the display driver according to the first embodiment. As already described, and as illustrated in FIG. 2, in the Command RAM Mode, the image data input from the host processor 11 are stored in the memory 3, and in a case of the still image, the image data which are stored in the memory 3 are repeatedly transferred to the display panel 12, and thereby the same still image continues to be displayed. As illustrated in FIG. 3, in the Video Through Mode, the image data input from the host processor 11 are sequentially displayed on the display panel 12. For example, when the moving image is displayed, the Video Through Mode is used. In a case of the Command RAM Mode illustrated in FIG. 2, since it is necessary to continue to retain the image data, the power always has to be supplied to the memory 3, and thereby the power supply switches 2 are turned on. In a case of the Video Through Mode illustrated in FIG. 3, since it is not necessary to continue to retain the image data in the memory 3, it is possible to stop the power supply to the memory 3 in order to reduce the off-leakage, and the power supply switches 2 are turned off.

Figure 4:
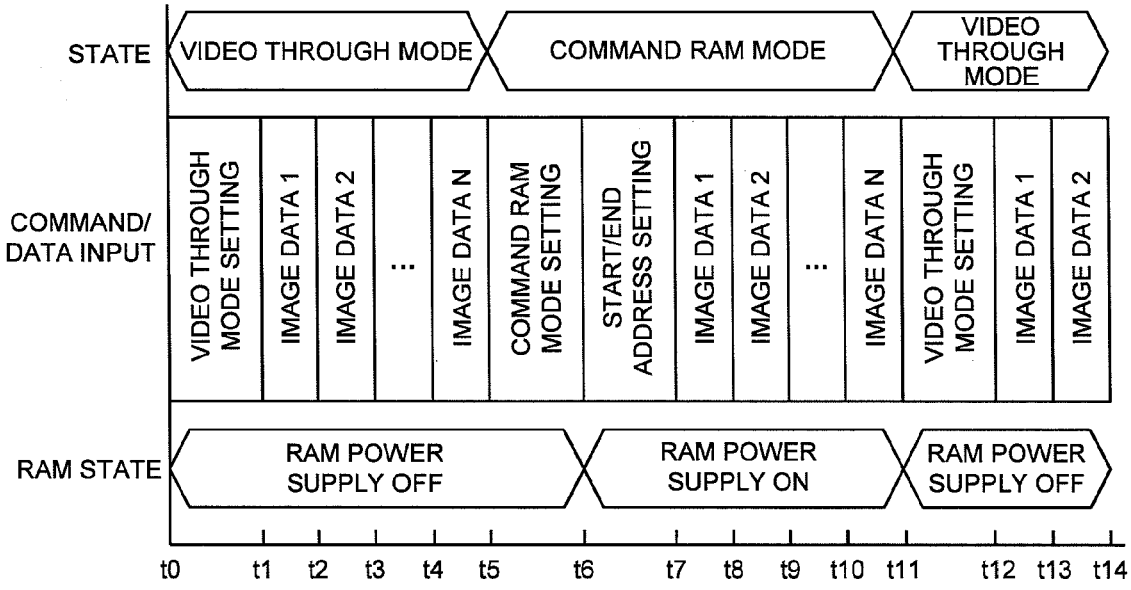
FIG. 4 is a timing diagram illustrating an operation example of the display driver according to the first embodiment.

FIG. 4 is a timing diagram illustrating an operation example of the display driver according to the first embodiment. A horizontal axis denotes time, and from the top in a vertical direction, a state of display driver 1, command and data which are input from the host processor 11, and a state of the memory (RAM state) are denoted. When a command which sets the display driver 1 to the Video Through Mode is input from the host processor 11 at time t0, the control circuit 7 interprets (decodes) the command, and as illustrated in FIG. 3, controls such that the input image data is directly supplied to the driver circuit 10, and further cuts off the power supply to the memory 3 by turning off the power supply switches 2. The image data 1, 2, . . . , n which are each input at times t1, t2, . . . , t4 are not written to the memory 3, and are supplied to the driver circuit 10. When a command which sets the display driver 1 to the Command RAM Mode at time t5 is input from the host processor 11, the control circuit 7 interprets (decodes) the command, and as illustrated in FIG. 2, sets the display driver 1 to the Command RAM Mode. The control circuit 7 controls such that the input image data is written to the memory 3, and the image data read from the memory 3 are supplied to the driver circuit 10. The start address and the end address of the memory 3 which are used in the Command RAM Mode are set by the host processor 11 at time t6. The control circuit 7 interprets (decodes) the start address and the end address, specifies the memory mat to which the image data is written at an initial time, and performs the above-described control such that the power supply to the memory mat becomes stable earlier than the power supply to the other memory mats. When first image data 1 is input at time t7, the power supply to the memory mat to which the image data is written at an initial time is already in a stable state. At that time, the power supply to the other memory mats may be in a state not started, or may be in a state still not stable although started. At times t8 to t10, until the remaining image data 2 to n are input, the power supply to the other memory mats may be stable. Once again, at time t11, if the command which sets the display driver 1 to the Video Through Mode is input from the host processor 11, the operation which is the same as the operation after the time t0 is repeated, a transition to the Video Through Mode is performed, and the power supply to the memory 3 is cut off again.

As described above, the control circuit 7 performs a control which starts the power supply to the memory 3 when the input command is the command which designates the Command RAM Mode, and performs a control which cuts off the power supply to the memory 3 when the input command is the command which designates the Video Through Mode. According to this, the power is supplied to the memory 3 in the Command RAM Mode which displays the still image stored in the memory 3, and the power supply to the memory 3 is cut off in the Video Through Mode which displays the moving image without using the memory 3, and thereby it is possible to suppress an unnecessary off-leakage current of the memory 3.

In addition, at this time, the control circuit 7 performs the designation according to the command which designates the Command RAM Mode, and specifies the memory mat to which the image data is written at an initial time, based on the start address and the end address of the memory 3. According to this, it is possible for the display driver 1 to specify the memory mat to which the image data is written at an initial time, without the special setting.

<Register for Designating Size of Display Panel Externally Connected to the Display Panel>

Figure 5:
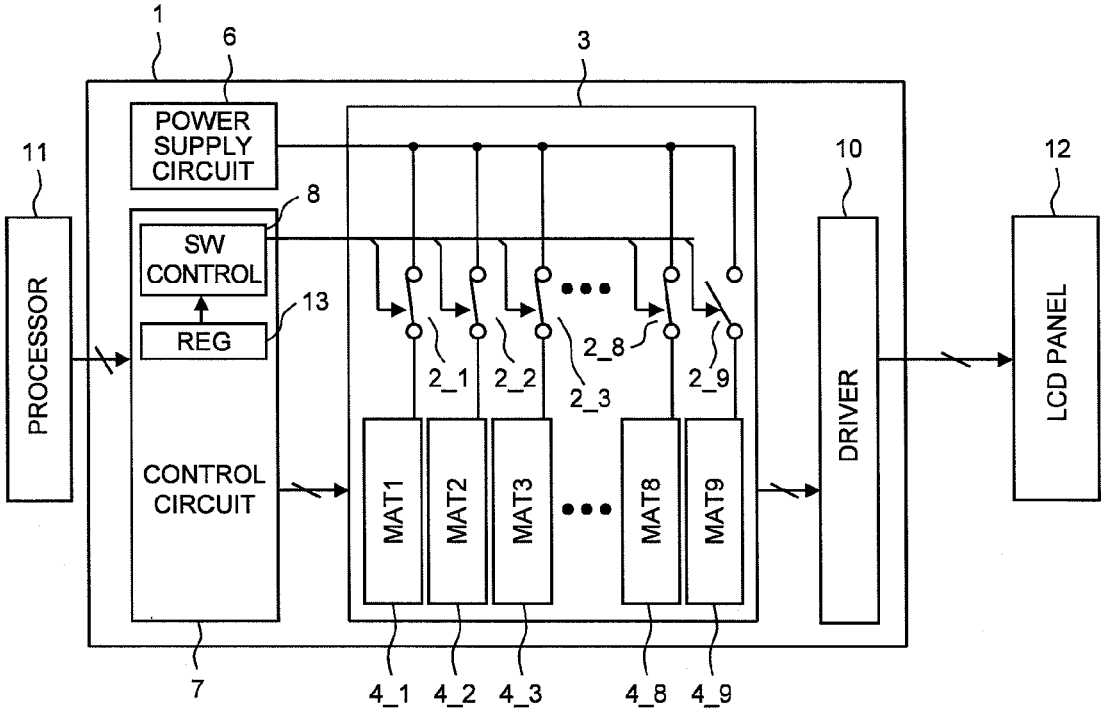
FIG. 5 is a block diagram illustrating a case where an operation of adapting the display driver according to the first embodiment to the number of pixels of a display panel connected thereto can be performed.

FIG. 5 is a block diagram illustrating a case where an operation of adapting a display driver according to a first embodiment to the number of pixels of a display panel externally connected to the display driver can be performed. The display driver 1 includes the driver circuit 10, the memory 3 including a plurality of memory mats 4_1 to 4_9, power supply switches 2_1 to 2_9 which are inserted between the power supply circuit 6 and each of the memory mats 4_1 to 4_9 and connected in series thereto, and the control circuit 7. The driver circuit 10 outputs the driving signal to the display panel 12 which is externally connected to the display driver 1. The display driver 1 is connected to both the host processor 11 and the display panel 12, and can display the image on the display panel 12, based on the image data input from the host processor 11. Although not particularly limited, the display panel 12 is, for example, the liquid crystal display panel (LCD panel). The display driver 1 is configured in such a manner that a display panel 12 with various sizes, that is, various pixel numbers can be connected thereto. The display panel 12 may have, for example, a full high definition of 1080 RGB×1920 dot, or Quad-VGA of 960 RGB×1280 dot. If one memory mat 4 has a memory capacity which can store bits of image data of 120 RGB, in a case where the display panel 12 connected to the display driver has a full high definition of 1080 RGB× 1920 dot, the power supply is required to supply to all nine units of the memory mats 4_1 to 4_9, and thus all the power supply switches 2_1 to 2_9 are turned on. In a case where display panel 12 connected to the display driver has the Quad-VGA of 960 RGB×1280 dot, it is sufficient to supply the power supply to all eight units of memory mats 4_1 to 4_8, and thus the power supply switches 2_1 to 2_8 are turned on, and the power supply switch 2_9 is controlled so as to be turned off.

The control circuit 7 includes a register 13 which can designate the size of the display panel 12 externally connected to the display driver 1. The display driver 1 can control the power supply switches 2_1 to 2_9 such that the power supply to a portion of the plurality of memory mats 4_1 to 4_9 is not performed, based on the value retained in the register 13.

According to this, it is possible for the display driver 1 to perform an appropriate power control, depending on the size (the number of pixels) of the display panel 12 externally connected to the display driver.

In the block diagram of the display driver 1 illustrated in FIG. 1, the memory 3 having eight memory mats is exemplarily illustrated, and in FIG. 5, the memory 3 having nine memory mats is exemplarily illustrated. The number of memory mats which configure the memory 3 may be arbitrarily set, based on access performance, a chip size or the like, and the examples illustrated in FIGS. 1 and 5 and the examples of the following embodiments are only simple exemplary illustrations.

The power supply switches 2 are inserted in series between the power supply circuit 6 and the memory mats 4, but after the power supply is cut off, in order to actively discharge electric charges remaining in the memory mats 4, a shunt switch which short-circuits a power supply line of the memory mats 4 to a ground potential may be further included.

[Second embodiment]

<Power supply switches connected in parallel with each other with different sizes from each other>

As an example of a specific method of turning on the power supply switches 2, in such a manner that the power supply to the memory mat to which the image data is written at an initial time, among the plurality of memory mats 4, becomes stable earlier than the power supply to the other memory mats, a method of configuring in such a manner that an ON-resistance of the power supply switch 2_1 which is turned on at an initial time is lower than an ON-resistance of the other power supply switches, will be described.

Figure 6:
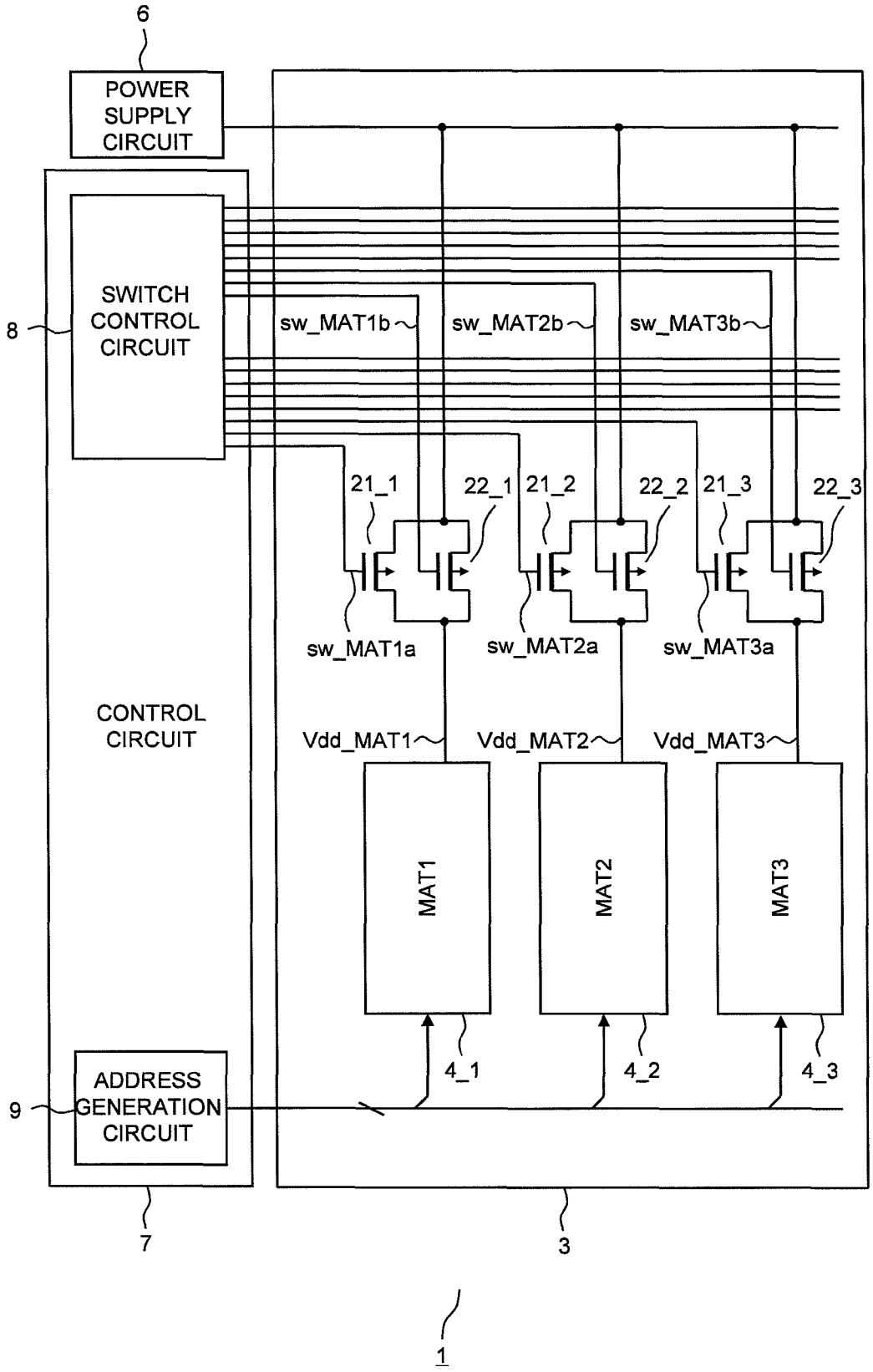
FIG. 6 is a block diagram illustrating essential units of a display driver according to a second embodiment.

FIG. 6 is a block diagram illustrating essential units of a display driver according to a second embodiment.

The display driver 1 according to a second embodiment, in the same manner as the display driver 1 illustrated in FIG. 1, includes the driver circuit 10 (not illustrated), the memory 3, the power supply switches 2, and the control circuit 7, is connected to the host processor 11 and the display panel 12 which are not illustrated, and can display the image on the display panel 12, based on the image data which is input from the host processor 11.

Even in the second embodiment, in the same manner as the first embodiment, the ON and OFF controls of the plurality of first and second power supply switches are performed, based on the command supplied from the host processor 11 externally connected to the display driver, and thereby the display driver 1 can perform the appropriate power supply control without the special setting. In addition, the control circuit 7 performs a control which starts the power supply to the memory 3 when the supplied command is a command which designates the Command RAM Mode, and performs a control which cuts off the power supply to the memory 3 when the command is a command which designates the Video Through Mode. When the command is the command which designates the Command RAM Mode, the control circuit 7 specifies the memory mat to which image data is written at an initial time, based on the start address and the end address, which are designated according to the command, of the memory.

In FIG. 6, the essential units of the display driver 1 according to the second embodiment are illustrated.

The memory 3 of the display driver 1 according to the second embodiment includes the plurality of memory mats 4_1 to 4_3. Three memory mats are illustrated, but the memory 3 may include more memory mats. The plurality of memory mats 4_1 to 4_3 are each connected to the first power supply switches 21_1 to 21_3 and the second power supply switches 22_1 to 22_3. The first power supply switches 21_1 to 21_3 and the second power supply switches 22_1 to 22_3 are respectively connected in parallel, and are each inserted in series between the power supply circuit 6 and power supply lines Vdd_MAT1 to Vdd_MAT3 connected to the memory mats 4_1 to 4_3. The control circuit 7 includes the address generation circuit 9 and the switch control circuit 8. The address generation circuit 9 performs a control which writes the input image data to the memory mats 4_1 to 4_3 and reads the image data. The switch control circuit 8 performs an ON and OFF control of the plurality of power supply switches 21_1 to 21_3 and 22_1 to 22_3. The first power supply switches 21_1 to 21_3 are configured by switching elements having low ON-resistances than those of the second power supply switches 22_1 to 22_3.

For example, the first and second power supply switches 21_1 to 21_3 and 22_1 to 22_3 are configured by MOSFETs, and the MOSFETs 21_1 to 21_3 which configure the first power supply switches are larger in the ratio of the gate width to the gate length than the MOSFETs 22_1 to 22_3 which configure the second power supply switches, and thereby it is possible to simply and correctly reduce the ON-resistances of the first power supply switches 21_1 to 21_3 more than those of the second power supply switches 22_1 to 22_3. Control signals sw_MAT1*a* to sw_MAT3*a* and sw_MAT1*b* to sw_MAT3*b* from a switch control circuit 8 of the control circuit 7 are connected to a gate terminal of each of the first power supply switches 21_1 to 21_3 and the second power supply switches 22_1 to 22_3. The first power supply switches 21_1 to 21_3 and the second power supply switches 22_1 to 22_3 can be each turned on or off independently.

In general, the lower the ON-resistance of the power supply switch is, the more the power supply switch performance is improved, and the ON-resistances of the first power supply switches 21_1 to 21_3 are designed in such a manner that voltage drops in the power supply lines Vdd_MAT1 to Vdd_MAT3 are within an allowable range, in case that accessing to the memory 3 is performed. In contrast, the ON-resistances of the second power supply switches 22_1 to 22_3 are designed with much higher values than those. A period where the first power supply switches 21_1 to 21_3 are turned off and only the second power supply switches 22_1 to 22_3 are turned on, is designed in such a manner so as not to occur in the memory mat access, or so as to be limited to the memory access so as to make the voltage drop only within the allowable range in the power supply lines Vdd_MAT1 to Vdd_MAT3.

In FIG. 6, an example is illustrated in which the MOSFETs 21_1 to 21_3 and 22_1 to 22_3 configuring the first and second power supply switches are P channel MOSFETs, but may be configured by N channel MOSFETs, depending on a method of reducing or controlling the leakage current, a circuit configuration, and a layout configuration. In this case, the control signals sw_MAT1*a* to sw_MAT3*a* and sw_MAT1*b* to sw_MAT3*b* of FIG. 7 described later reverse high levels and low levels.

The control circuit 7 turns on the first power supply switch 21_1 earlier than the second power supply switch 22_1, with respect to at least one of the plurality of memory mats 4_1 to 4_3, for example, the memory mat 4_1, and turns on the second power supply switch earlier than the first power supply switches 21_2 and 21_3, with respect to the other memory mats, for example, the memory mats 4_2 and 4_3.

According to this, even when the off-leakage current of the image memory is reduced by the ON and OFF control of the power supply to the image memory, it is possible to suppress to a low value the inrush current occurring when the power supply to the memory 3 is started, without image data writing to the memory being delayed, and without a complicated timing control being performed.

Figure 7:
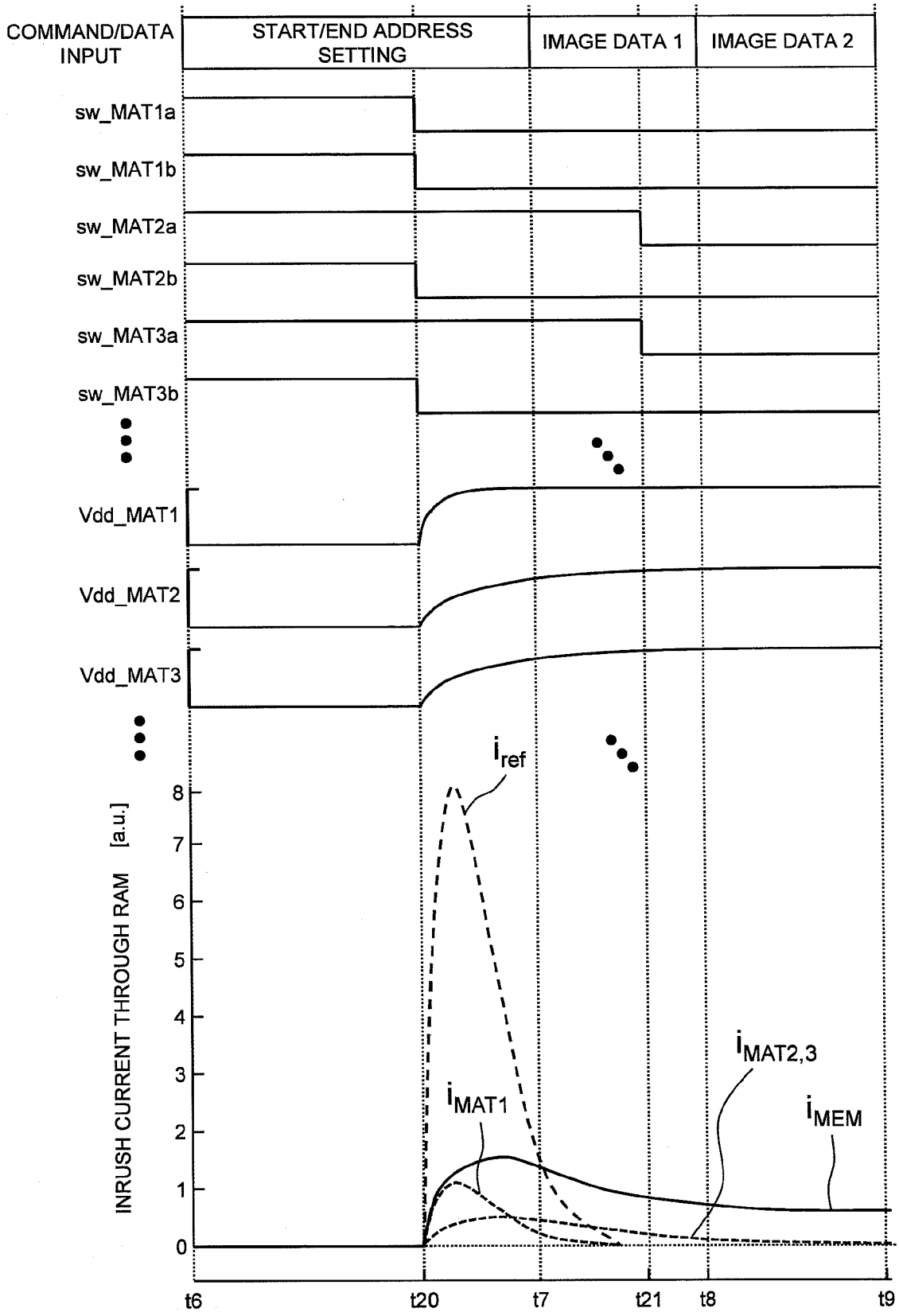
FIG. 7 is a timing diagram illustrating an operation example of the display driver according to the second embodiment.

FIG. 7 is a timing diagram illustrating an operation example of a display driver according to a second embodiment. A horizontal axis denotes time, and from the top in a vertical direction, commands and data which are input from the host processor 11, waveforms of the control signals sw_MAT1*a* to sw_MAT3*a* and sw_MAT1*b* to sw_MAT3*b* which control the first power supply switches 21_1 to 21_3 and the second power supply switches 22_1 to 22_3, voltages of the power supply lines Vdd_MAT1 to Vdd_MATS of the memory mats 4_1 to 4_3, and a state of the inrush current flowing through the memory 3 are denoted. As the inrush current flowing through the memory 3, an inrush current $i_{MAT1}$ flowing through the memory mat 4_1 (MAT1) to which the image data is written at an initial time, inrush currents $i_{MAT2}$ and $i_{MAT3}$ flowing through the other memory mats 4_2 and 4_3 (MAT2 and MAT3), and inrush current $i_{MEM}$ flowing through the whole memory 3 are denoted. Further, as a comparative example, an inrush current $i_{ref}$ flowing through the memory 3 is denoted which is generated when a control that simultaneously turns on all the power supply switches connected to all the memory mats is performed, in order to start the power supply to the memory 3. At this time, it is assumed that all the power supply switches (power supply switches in which the first power supply switches 21_1 to 21_3 and the second power supply switches 22_1 to 22_3 are each connected in parallel with each other) connected to all the memory mats are designed so as to suppress the voltage drop generated on the power supply lines Vdd_MAT1 to Vdd_MAT3 within the allowable range, in case that accessing of the memory 3 is performed in the same manner as the ON-resistance of a normal power supply switch. Since an actual magnitude of the inrush current depends on storage capacitance of the memory mat or a physical constant, the actual magnitude of the inrush current is denoted by an arbitrary unit (a.u.) in FIG. 7.

A time axis (horizontal axis) of FIG. 7 corresponds to a section from time t6 to time t9 of FIG. 4. After the command which sets the display driver 1 to the Command RAM Mode is input from the host processor 11 at time t5, the start address and the end address of the memory 3 used in the Command RAM Mode is designated at time t6, image data 1 are input and written to the MAT1 (memory mat 4_1) at time t7, and image data 2 are input and written to the MAT2 (memory mat 4_2) at time t8.

In the example illustrated in FIG. 7, at time t6, the start address and the end address, which are designated by the host processor 11, of the memory 3 used in the Command RAM Mode are interpreted (decoded) by the control circuit 7, and thereby the memory mat to which image data is written at an initial time is specified as MAT1 (memory mat 4_1). Thereafter, at time t20, in order to preferentially start the power supply to the MAT1 to which the image data is written at an initial time, the first power supply switch 21_1, which is connected to the MAT1, with a lower ON-resistance is turned on. At this time, the second power supply switch 22_1 may also be simultaneously turned on. In contrast, at the time t20, in a state where the first power supply switches 21_2 and 21_3, which are connected to the other memory mats 4_2 and 4_3 (MAT2 and MAT3), with lower ON-resistances are turned off, the second power supply switches 22_2 and 22_3 are controlled so as to be turned on. Since the first power supply switch 21_1 has a low ON-resistance, the power Vdd_MAT1 of the MAT1 is rapidly increased and then becomes stable. Thus, a relatively large inrush current $i_{MAT1}$ flows through the MAT1. In contrast, since the power supply to the other memory mats 42 and 4_3 (MAT2 and MAT3) is started by the second power supply switches 22_2 and 22_3 with high ON-resistances, the powers Vdd_MAT2 and Vdd_MAT3 of the MAT2 and MAT3 are slowly increased, and thereby a long time is required to become stable, but the inrush currents $i_{MAT2}$ and $i_{MAT3}$ which flow through the MAT2 and MAT3 can be suppressed to a low value. For this reason, the inrush current $i_{MEM}$ flowing through the whole memory 3 can also be suppressed to a significantly lower value than the inrush current $i_{ref}$ of the comparative example. At time t21, the first power supply switches 21_2 and 21_3, which are connected to the MAT2 and the MAT3, with low ON-resistances are also controlled so as to be turned on.

The time t20 when the first power supply switch 21_1, which is connected to the MAT1 to which the image data is written at an initial time, with a low ON-resistance is turned on, at the time t7 when the writing of the image data 1 to the MAT1 is started, is determined so as to have a time margin for stabilizing the power supply voltage Vdd_MAT1 of the MAT1 by exceeding a predetermined voltage. The time t21 when the first power supply switch 21_2, which is connected to the MAT2 to which the other image data 2 are input, with a low ON-resistance is turned on, is set earlier than the time t8 when the image data 2 begins to input, after the time t20. When the time t21 is close to the time t20, the power supply voltage Vdd_MAT2 of the MAT2 has not risen enough yet, and the first power supply switch 21_2 with a low ON-resistance is turned on, and thereby the inrush current $i_{MAT2}$ increases from that time. It is set in such a manner that an overlap with the waveform of the inrush current $i_{MAT1}$ flowing through the MAT1 is reduced and the inrush current $i_{MEM}$ through the whole memory 3 does not increase. In contrast, until the time t8 when the image data 2 are input, the first power supply switch 21_2, which is connected to the MAT2, with a low ON-resistance is turned on, the Vdd_MAT2 exceeds a predetermined voltage, thereby becoming stable, and power supply impedance is required to be equal to or less than a predetermined value. Further, a first power supply switch 21_3, which is connected to the MAT3 to which another image data 3 are input, with a low ON-resistance is not required to always be turned on before the time t8. Until the time when the image data 3 are input, the Vdd_MAT3 exceeds a predetermined voltage thereby becoming stable, and power supply impedance may be equal to or less than a predetermined value.

By the above idea, it is possible to determine the time when the first power supply switch 21_1, which is connected to the MAT1 to which the image data 1 is written at an initial time, with a low ON-resistance is turned on, and the time when the first power supply switches 21_2 and 21_3, which are connected to the other memory mats are turned on. According to this, the image data writing to the memory is not required to be delayed until the power supply voltage becomes stable, and it is possible to suppress to a low value the inrush current occurring when the power supply to the memory 3 is started, without the complicated timing control being performed.

[Third embodiment]

Power supply switch being sequentially turned on

As an example of a specific method of turning on the power supply switches 2, in such a manner that the power supply to the memory mat to which the image data is written at an initial time, among the plurality of memory mats 4, becomes stable earlier than the power supply to the other memory mats, a method of turning on the power supply switch 2_1 which supplies the power to the memory mat 4_1 to which the image data is written at an initial time earlier than the power supply switches 2_2 to 2_8 which supply the power to the other memory mats 4_2 to 4_8, using a timing control, will be described.

Figure 8:
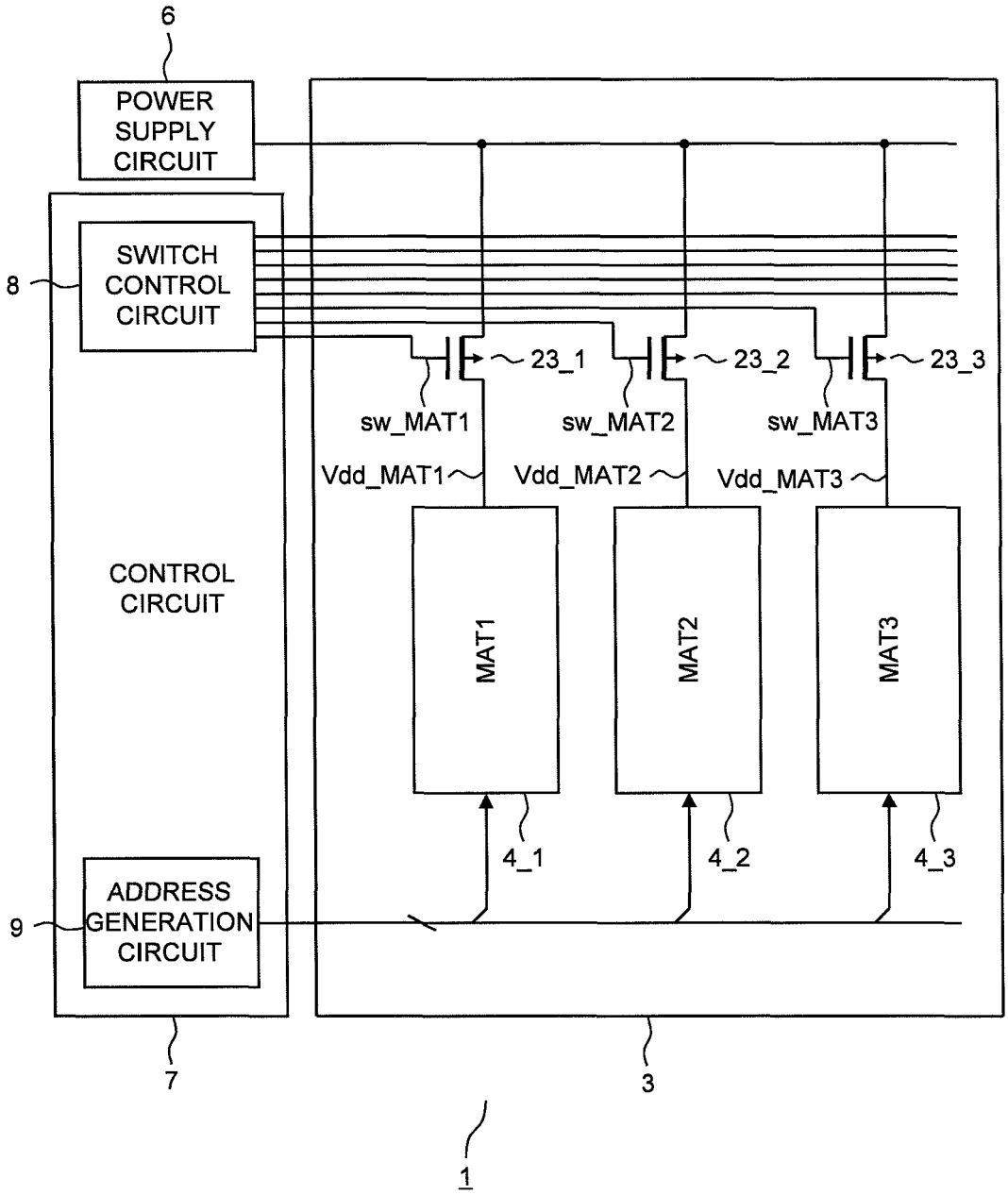
FIG. 8 is a block diagram illustrating essential units of a display driver according to a third embodiment.

FIG. 8 is a block diagram illustrating essential units of a display driver according to a third embodiment.

The display driver 1 according to a third embodiment, in the same manner as the display driver 1 illustrated in FIG. 1, includes the driver circuit 10 (not illustrated), the memory 3, the power supply switches 2, and the control circuit 7, is connected to the host processor 11 and the display panel 12 which are not illustrated, and can display the image on the display panel 12, based on the image data which is input from the host processor 11.

Even in the third embodiment, in the same manner as the first embodiment, the plurality of power supply switches perform the ON and OFF control, based on the command supplied from the host processor 11 externally connected to the display driver, and thereby the display driver 1 can perform the appropriate power control without the special setting. In addition, the control circuit 7 performs a control which starts the power supply to the memory 3 when the supplied command is a command which designates the Command RAM Mode, and performs a control which cuts off the power supply to the memory 3 when the command is a command which designates the Video Through Mode. When the command is the command which designates the Command RAM Mode, the control circuit 7 specifies the memory mat to which image data is written at an initial time, based on the start address and the end address, which are designated according to the command, of the memory.

In FIG. 8, essential units of the display driver 1 according to the third embodiment are illustrated.

The memory 3 of the display driver 1 according to the third embodiment includes the plurality of memory mats 4_1 to 4_3. Three memory mats are illustrated, but the memory 3 may include more memory mats. Power supply switches 23_1 to 23_3 are inserted in series between the power supply circuit 6 and each of the power supply lines Vdd_MAT1 to Vdd_MAT3 connected to the memory mats 4_1 to 4_3. The control circuit 7 includes the address generation circuit 9 and the switch control circuit 8. The address generation circuit 9 performs a control which writes the input image data to the memory mats 4_1 to 4_3 and reads the image data. The switch control circuit 8 performs an ON and OFF control of the plurality of power supply switches 23_1 to 23_3. The power supply switches 23_1 to 23_3 are each configured by a switching element having the same ON-resistance as the ON-resistance which is generated by connecting the first power supply switches 21_1 to 21_3 and the second power supply switches 22_1 to 22_3 according to the second embodiment, in parallel with each other.

For example, the power supply switches 23_1 to 23_3 are configured by MOSFETs. The control signals sw_MAT1 to sw_MAT3 from the switch control circuit 8 of the control circuit 7 are applied to each gate terminal of the power supply switches 23_1 to 23_3, and it is possible to independently perform the ON and OFF control of each of the power supply switches 23_1 to 23_3.

In FIG. 8, an example is illustrated in which the MOSFETs 23_1 to 23_3 configuring the power supply switches are P channel MOSFETs, but may be configured by N channel MOSFETs, depending on a method of reducing or controlling the leakage current, a circuit configuration, and a layout configuration. In this case, the control signals sw_MAT1 to sw_MAT3 of FIG. 9 described later reverse high levels and low levels.

The control circuit 7 can perform a control that turns on the power supply switch 23_1 connected to at least one, for example, MAT1 (memory mat 4_1), among the plurality of memory mats 4_1 to 4_3, earlier than the power supply switches 23_2 to 23_3 connected to the other memory mats, for example, MAT2 and MAT3 (memory mats 4_2 and 4_3).

According to this, even when the off-leakage current of the image memory is reduced by the ON and OFF control of the power supply to the image memory, the image data writing to the memory is not delayed, and in addition, by connecting only one power supply switch to one memory mat, it is possible to suppress to a low value the inrush current occurring when the power supply to the memory 3 is started.

Further, the control circuit 7 starts the power supply by sequentially turning on the power supply switches 23_1 to 23_3 connected to each of the plurality of memory mats 4_1 to 4_3, and thereby it is possible to suppress to a lower value a peak value of the inrush current occurring when the power supply to the memory 3 is started.

Figure 9:
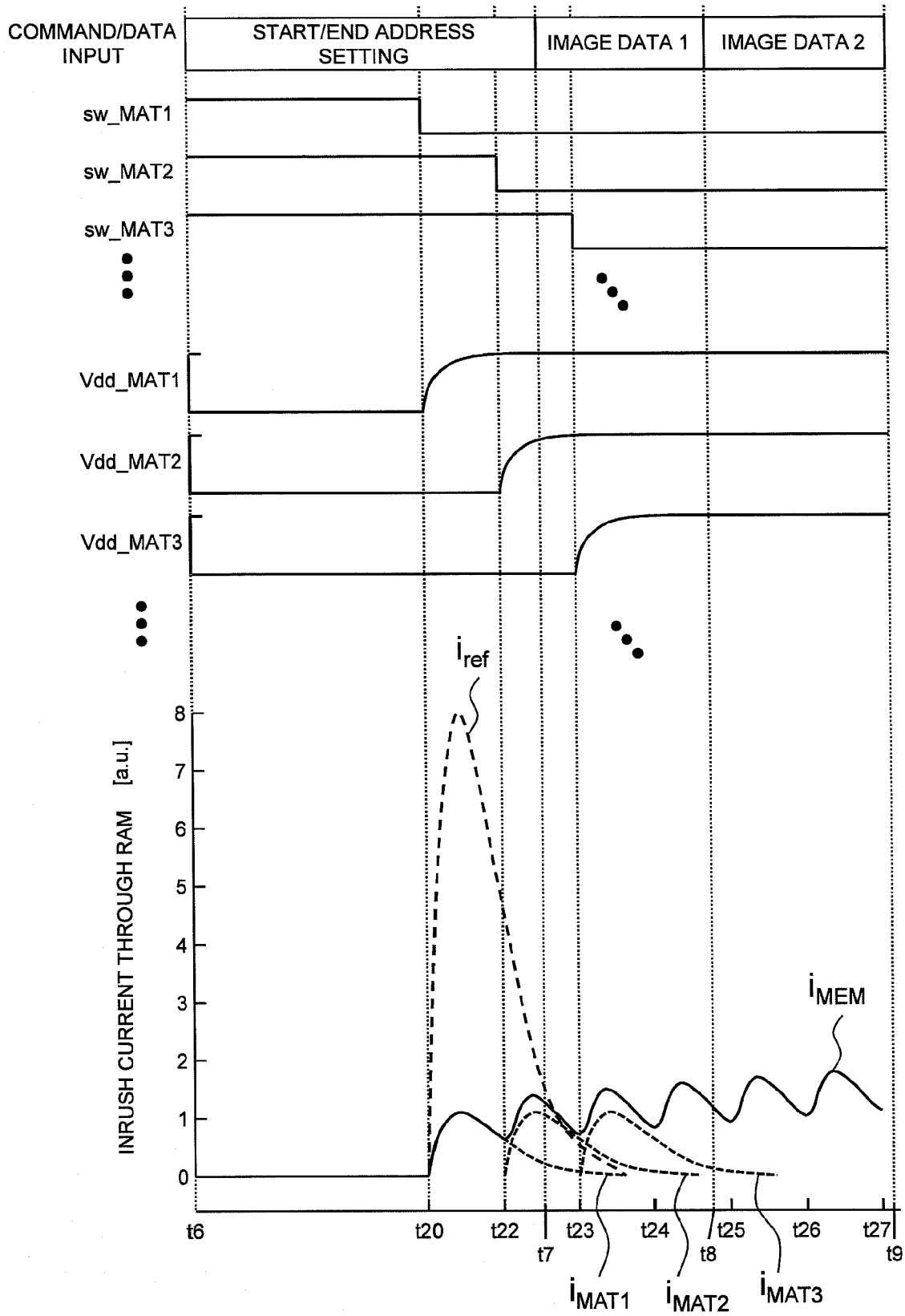
FIG. 9 is a timing diagram illustrating an operation example of the display driver according to the third embodiment.

FIG. 9 is a timing diagram illustrating an operation example of the display driver according to the third embodiment. A horizontal axis denotes time, and from the top in a vertical direction, commands and data which are input from the host processor 11, waveforms of the control signals sw_MAT1 to sw_MAT3 which control the power supply switches 23_1 to 23_3, voltages of the power supply lines Vdd_MAT1 to Vdd_MAT3 of the memory mats 4_1 to 4_3, and a state of the inrush current flowing through the memory 3 are denoted. As the inrush current flowing through the memory 3, inrush currents $i_{MAT1}$, $i_{MAT2}$, and $i_{MAT3}$ flowing through each of the memory mats 4_1 to 4_3, and inrush current $i_{MEM}$ flowing through the whole memory 3 are denoted. Further, as a comparative example, an inrush current $i_{ref}$ flowing through the memory 3 is denoted which is generated when a control that simultaneously turns on all the power supply switches connected to all the memory mats is performed, in order to start the power supply to the memory 3. Since an actual magnitude of the inrush current depends on storage capacitance of the memory mat or a physical constant, the actual magnitude of inrush current is denoted by an arbitrary unit (a.u.) in FIG. 9.

A time axis (horizontal axis) of FIG. 9 corresponds to a section from time t6 to time t9 of FIG. 4. After the command which sets the display driver 1 to the Command RAM Mode is input from the host processor 11 at time t5, the start address and the end address of the memory 3 used in the Command RAM Mode is designated at time t6, image data 1 are input and written to the MAT1 (memory mat 4_1) at time t7, and image data 2 are input and written to the MAT2 (memory mat 4_2) at time t8.

In the example illustrated in FIG. 9, in the same manner as that illustrated in FIG. 7 with regard to the second embodiment, at time t6, the start address and the end address, which are designated by the host processor 11, of the memory 3 used in the Command RAM Mode are interpreted (decoded) by the control circuit 7, and thereby the memory mat to which image data is written at an initial time is specified as MAT1 (memory mat 4_1). Thereafter, at time t20, in order to preferentially start the power supply to the MAT1 to which the image data is written at an initial time, the power supply switch 23_1 connected to the MAT1 at an initial time is turned on. Thereafter, a control is performed in which the power supply switches 23_2 to 23_3 connected to the other memory mats 4_2 and 4_3 (MAT2 and MAT3) are turned on. In FIG. 9, an example is illustrated in which the power supply switches 23_1 to 23_3 which are connected to each of the plurality of memory mats 4_1 to 4_3 are sequentially turned on at times t20, t22, and t23. Since the power supply switch 23_1 has a low ON-resistance, the power supply voltage Vdd_MAT1 of the MAT1 increases rapidly to become stable. Thus, a relatively large inrush current $i_{MAT1}$ flows through the MAT1. Thereafter, operations are sequentially performed that the power supply voltage Vdd_MAT2 of the MAT2 (memory mat 4_2) increases from time t22, then the inrush current $i_{MAT2}$ flows through the MAT2, and the power supply voltage Vdd_MAT3 of the MAT3 (memory mat 4_3) increases from time t23 and then the inrush current $i_{MAT3}$ flows through the MAT3. The waveforms of each inrush current are equal to each other, but since the peak values are shifted in time, the peak value of the inrush current $i_{MEM}$ flowing through the whole memory 3 can be significantly suppressed to a lower value than the peak value of the inrush current $i_{ref}$ of the comparative example.

[Fourth Embodiment]

<Image data retaining mode>

In the display driver 1 according to the fourth embodiment, in the same manner as the second embodiment, the power supply switches which includes the first power supply switches with lower ON-resistances and the second power supply switches with higher ON-resistances connected in parallel with each other, are connected to each of the plurality of memory mats. The power supply switch of the MAT1 (memory mat 4_1) is configured by the first power supply switch 21_1 and the second power supply switch 22_1 which are connected in parallel with each other, and control signals thereof are each set as sw_MAT1*a* and sw_MAT1*b*. In addition, as described in the first embodiment, among the plurality of memory mats, only the memory mats required for storing the image data of the size in accordance with the size (the number of pixels) of the display panel 12 connected to the display driver 1, become enable states, and the other memory mats become disable states thereby cutting off the power supply.

The control circuit 7 of the display driver 1 according to the fourth embodiment, has a function of turning off the first power supply switch connected to the memory mat specified based on the command, and of turning on the second power supply switch. In the second embodiment, only the second power supply switch with a high ON-resistance is transiently turned on, and thereby an effect of suppressing the inrush current is obtained, and until the time when accessing of the memory mat, the first power supply switch with a low ON-resistance is also turned on. In contrast, in the fourth embodiment, in a state where the first power supply switch is turned off, a period where only the second power supply switch is turned on is actively designed. According to this, during a period without the memory access, the leakage current is suppressed to a low value, and thus it is possible to retain the image data in the image memory 3. The second power supply switch, instead of the power supply switch with a high ON-resistance connected in parallel with the first power supply switch, can also be set as a power supply switch which suppress the leakage current by applying a back bias to a memory cell, and in addition, a source potential of the MOSFET which configures the memory cell is controlled so as to become a reverse bias state, and thereby the second power supply switch can also be set as the power supply switch which suppresses the leakage current. At this time, the memory 3 is operated in a low leakage current image data retaining mode, and thus the power supply for retaining the data may be further included.

Figure 10:
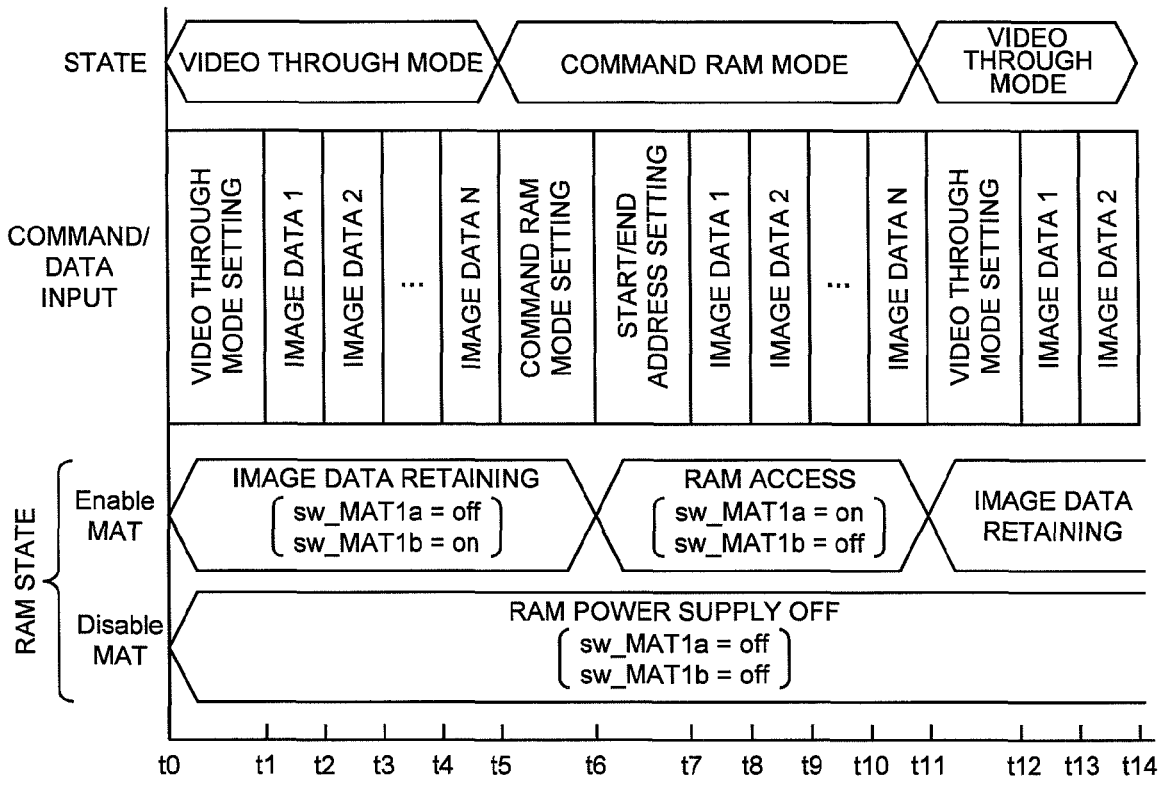
FIG. 10 is a timing diagram illustrating an operation example of a display driver according to a fourth embodiment.

FIG. 10 is a timing diagram illustrating an operation example of the display driver according to the fourth embodiment. In the same manner as the timing diagram illustrating the operation of the display driver 1 according to the second embodiment illustrated in FIG. 4, a horizontal axis denotes the time, and from the top in a vertical direction, a state of the display driver 1, commands and data which are input from the host processor 11, and a state of the memory 3 (RAM state) are denoted. The state (RAM state) of the memory 3 is divided into the memory mat (Enable MAT) of the enable state which is selected and controlled based on the size of the image to be stored, and the memory mat (Disable MAT) of the disable state, and then illustrated.

When the command, which sets the display driver 1 to the Video Through Mode, is input from the host processor 11 at time t0, the control circuit 7 interprets (decodes) the command, and as illustrated in FIG. 3, controls in such a manner that the input image data can be directly supplied to the driver circuit 10. At this time, in the second embodiment, the power supply to the memory 3 is cut off by turning off the power supply switches 2, but in the fourth embodiment, in a state where the first power supply switch 21_1 with a low ON-resistance is turned off by the control signal sw_MAT1*a*, a control is performed which turns on the second power supply switch 22_1 with a high ON-resistance using the control signal sw_MAT1*b*. The image data 1, 2, . . . , n which are each input at the times t1, t2, . . . , t4 are not written to the memory 3, and are supplied to the driver circuit 10. During the period, the image data stored in the memory 3 according to the second embodiment is lost, but the image data stored in the memory 3 according to the fourth embodiment is retained.

Thereafter, in the same manner as the second embodiment, when the command which sets the display driver 1 to the Command RAM Mode is input from the host processor 11 at the time t5, the control circuit 7 interprets (decodes) the command and set the display driver 1 to the Command RAM Mode, as illustrated in FIG. 2. The control circuit 7 performs a control, in such a manner that the input image data is written to the memory 3, and the image data read from the memory 3 is supplied to the driver circuit 10. At the time t6, the start address and the end address, which are used in the Command RAM Mode, of the memory 3 are designated by the host processor 11. The control circuit 7 interprets (decodes) the start address and the end address, specifies the memory mat to which the image data is written at an initial time, and performs the control which turns on the first power supply switch 21_1 in such a manner that the power supply to the memory mat becomes stable earlier than the power supply to the other memory mats. At the time t7, when the first image data 1 is input, a power supply impedance for the power supply to the memory mat to which the image data is written at an initial time is switched to a low value so as to endure the access. A power supply impedance of the power supply to the other memory mats may not be changed to a low value at the time, and until the image data 2 to n remaining at times t8 to t10 are input, the power supply impedance may be in a state changed to a low value. Once again, at time t11, when the command which sets the display driver 1 to the Video Through Mode is input from the host processor 11, the same operation as the operation after the time t0 is repeated, a transition to the Video Through Mode is performed, the power supply to the memory 3 is maintained only by the second power supply switch with a high impedance, and the image data is retained.

As described above, it is possible to retain the image data in the image memory 3 while the leakage current is suppressed to a low value, during the period without the memory access. In addition, it is possible to perform a transition to a power supply state in which the memory access can be made, in a shorter time than the time when power supply which is in a power supply cutting off state is restarted, with respect to the image memory 3.

As described above, the invention made by the present inventor is specifically described based on the embodiments, but the present invention is not limited thereto, and various changes may be made without departing from the gist thereof.

For example, a display device driven by the display driver according to the invention has mainly been employed and described as the liquid crystal display panel as an example, but can be employed in an organic Electro Luminescence (EL) display panel, a plasma display panel, or a display driver which drives any other display devices.

What is claimed is:

1. A display driver comprising:

a driver circuit which can output a driving signal to a display panel externally connected to the display driver;

a memory which is configured to include a plurality of memory mats and can store image data for generating the driving signal;

a plurality of power supply switches which can perform an ON and OFF control of power supply to each of the plurality of memory mats; and a control circuit which can perform the ON and OFF control of the plurality of power supply switches, wherein the image data is stored into the plurality of the memory mats sequentially in a predetermined order, and wherein the control circuit can perform a control which turns on the plurality of power supply switches in such a manner that power supply to the memory mat to which the image data is written at an initial time, among the plurality of memory mats, becomes stable earlier than power supply to the other memory mats.

2. The display driver according to claim 1, wherein the plurality of power supply switches are configured to include first switches and second switches which are connected to each of the plurality of memory mats, the first switch and the second switch are connected in parallel with each other, and an ON-resistance of the first switch is lower than that of the second switch, and wherein the control circuit starts the power supply to the memory mat to which the image data is written at an initial time by turning on the first switch earlier than the second switch, and starts the power supply to the other memory mats by turning on the second switch than the first switch.

3. A display driver compromising:

a driver circuit which can output a driving signal to a display panel externally connected to the display driver;

a memory which is configured to include a plurality of memory mats and can store image data for generating the driving signal;

a plurality of power supply switches which can perform an ON and OFF control of power supply to each of the plurality of memory mats; and a control circuit which can perform the ON and Off control of the plurality of the power supply switches, wherein the control circuit can perform a control which turns on the plurality of power supply switches in such a manner that power supply to the memory mat to which the image data is written at an initial time, among the plurality of memory mats, becomes stable earlier than power supply to the other memory mats, wherein the plurality of power supply switches are configured to include first switches and second switches which are connected to each of the plurality of memory mats, the first switch and the second switch are connected in parallel with each other, and an ON-resistance of the first switch is lower than that of the second switch, and wherein the control circuit starts the power supply to the memory mat to which the image data is written at an initial time by turning on the first switch earlier than the second switch , and starts the power supply to the other memory mats by turning on the second switch than the first switch, and wherein the first switch and the second switch are configured to include MOSFETs, and the MOSFET which configures the first switch is larger in a ratio of a gate width to a gate length earlier than the MOSFET which configures the second switch.

4. A display driver compromising:

a driver circuit which can output a driving signal to a display panel externally connected to the display driver;

a memory which is configured to include a plurality of memory mats and can store image data for generating the driving signal;

a plurality of power supply switches which can perform an ON and OFF control of power supply to each of the plurality of memory mats; and a control circuit which can perform the ON and OFF control of the plurality of power supply switches, wherein the control circuit can perform a control which turns on the plurality of power supply switches in such a manner that power supply to the memory mat to which the image data is written at an initial time, among the plurality of memory mats, becomes stable earlier than power supply to the other memory mats, wherein the plurality of power supply switch are configured to include power supply switches connected to each of the plurality of memory mats, and wherein the control circuit starts the power supply by turning on the power supply switch connected to the memory mat to which the image data is written at an initial time earlier than the power supply switches connected to the other memory mats.

5. The display driver according to claim 4, wherein the control circuit starts the power supply by sequentially turning on the power supply switches connected to each of the plurality of memory mats.

6. The display driver according to claim 1, wherein the control circuit can receive a command supplied from a host processor externally connected to the display driver, and can perform the ON and OFF control of the plurality of power supply switches based on the received command.

7. A display driver comprising:

a driver circuit which can output a driving signal to a display panel externally connected to the display driver;

a memory which is configured to include a plurality of memory mats and can store image data for generating the driving signal;

a plurality of power supply switches which can perform an ON and OFF control of power supply to each of the plurality of memory mats; and a control circuit which can perform the ON and OFF control of the plurality of power supply switches, wherein the control circuit can perform a control which turns on the plurality of power supply switches in such a manner that power supply to the memory mat to which the image data is written at an initial time, among the plurality of memory mats, becomes stable earlier than power supply to the other memory mats, wherein the control circuit can receive a command supplied from a host processor externally connected to the display driver, and can perform the ON and OFF control of the plurality of power supply switches based on the received command, and wherein the control circuit performs a control which starts the power supply to the memory when the command is a command which designates a Command RAM Mode, and performs a control which cuts off the power supply to the memory when the command is a command which designates a Video Through Mode.

8. The display driver according to claim 7, wherein when the command is the command which designates the Command RAM Mode, the control circuit has a function of specifying the memory mat to which the image data is written at an initial time, based on a start address and an end address, which are designated according to the command, of the memory.

9. A display driver compromising:

a driver circuit which can output a driving signal to a display panel externally connected to the display driver;

a memory which is configured to include a plurality of memory mats and can store image data for generating the driving signal;

a plurality of power supply switches which can perform an ON and OFF control of power supply to each of the plurality of memory mats; and a control circuit which can perform the ON and Off control of the plurality of power supply switches, wherein the control circuit can perform a control which turns on the plurality of power supply switches in such a manner that power supply to the memory mat to which the image data is written at an initial time, among the plurality of memory mats, becomes stable earlier than power supply to the other memory mats, and wherein the control circuit includes a register which can designate a size of the display panel externally connected to the display driver, and can perform a control which does not perform the power supply to a portion of the plurality of memory mats based on a value retained in the register.

10. A display driver comprising:

a driver circuit which can output a driving signal to a display panel externally connected to the display driver;

a memory which is configured to include a plurality of memory mats and can store image data for generating the driving signal; and a control circuit which is connected to a plurality of power supply switches, each power supply switch of the plurality of power supply switches including a first power supply switch connected in parallel with a second power supply switch, each pair of first and second power supply switches being connected to a respective memory mat of the plurality of memory mats, the control circuit being configured to perform an ON and OFF control of power supply to each memory mat of the plurality of memory mats, while an ON-resistance of the first power supply switch is lower than that of the second power supply switch, and is configured to perform an ON and OFF control of each of the plurality of first and second power supply switches, wherein the control circuit can perform a control which turns on the first power supply switch earlier than the second power supply switch with respect to at least one of the plurality of memory mats and turns on the second power supply switch earlier than the first power supply switch with respect to the other memory mats.

11. A display driver comprising:

a driver circuit which can output a driving signal to a display panel externally connected to the display driver;

a memory which is configured to include a plurality of memory mats and can store image data for generating the driving signal; and a control circuit which is connected to a first power supply switch and a second power supply switch that are connected in parallel with each other and can perform an ON and OFF control of power supply to each memory mat which configures the plurality of memory mats, while an ON-resistance of the first power supply switch is lower than that of the second power supply switch, and can perform an ON and OFF control of the plurality of first and second switches, wherein the control circuit can perform a control which turns on the first power supply switch earlier than the second power supply switch with respect to at least one of the plurality of memory mats and turns on the second power supply switch earlier than the first power supply switch with respect to the other memory mats, and wherein the first power supply switch and the second power supply switch are configured to include MOSFETs, and the MOSFET which configures the first power supply switch is larger in a ratio of a gate width to a gate length than the MOSFET which configures the second power supply switch.

12. The display driver according to claim 10, wherein the control circuit can receive a command supplied from a host processor externally connected to the display driver, and can perform the ON and OFF control of the plurality of first and second power supply switches based on the received command.

13. A display driver comprising:

a driver circuit which can output a driving signal to a display panel externally connected to the display driver;

a memory which is configured to include a plurality of memory mats and can store image data for generating the driving signal; and a control circuit which is connected to a first power supply switch and a second power supply switch that are connected in a parallel with each other and can perform an ON and OFF control of power supply to each memory mat which configures the plurality of memory mats, while an ON-resistance of the first power supply switch is lower than that of the second power supply switch, and can perform an ON and Off control of each of the plurality of first and second switches, wherein the control circuit can perform a control which turns on the first power supply switch earlier than the second power supply switch with respect to at least one of the plurality of memory mats and turns on the second power supply switch earlier than the first power supply switch with respect to the other memory mats, wherein the control circuit can receive a command supplied from a ghost processor externally connected to the display driver, and can perform the ON and OFF control of the plurality of the first and second power supply switches based on the received command, and wherein the control circuit performs a control which starts the power supply to the memory when the command is a command which designates a Command RAM Mode, and performs a control which cuts off the power supply to the memory when the command is a command which designates a Video Through Mode.

14. The display driver according to claim 13, wherein when the command is the command which designates the Command RAM Mode, the control circuit has a function of specifying the memory mat which is a target of the control of turning on the first power supply switch earlier than the second power supply switch, based on a start address and an end address, which are designated according to the command, of the memory.

15. A display driver comprising:

a driver circuit which can output a driving signal to a display panel externally connected to the display driver;

a memory which is configured to include a plurality of memory mats and can store image data for generating the driving signal; and a control circuit which is connected to a first power supply switch and a second power supply switch that are connected in a parallel with each other and can perform an ON and OFF control of power supply to each memory mat which configures the plurality of memory mats, while an ON-resistance of the first power supply switch is lower than that of the second power supply switch, and can perform an ON and OFF control of each of the plurality of the first and second switches, wherein the control circuit can perform a control which turn on the first power supply switch earlier than the second power supply switch with respect to at least one of the plurality of memory mats and turns on the second power supply switch earlier than the first power supply switch with respect to the memory mats, wherein the control circuit can receive a command supplied from a host processor externally connected to the display driver, and can perform an ON and Off control of the plurality of the first and second power supply switches based on the received command, and wherein the control circuit performs a control which starts the power supply to the memory when the command is a command which designates a Command RAM Mode, and performs a control which maintains the power supply to the memory to a low leakage current when the command is a command which designates a Video Through Mode.

16. A display driver comprising:

a driver circuit which can output a driving signal to a display panel externally connected to the display driver;

a memory which is configured to include a plurality of memory mats and can store image data for generating the driving signal;

power supply switches which are connected to each of the plurality of memory mats, and can perform an ON and OFF control of power supply to each of the plurality of memory mats; and a control circuit which can perform the ON and OFF control of the power supply switch, wherein the image data is stored into the plurality of the memory mats sequentially in a predetermined order, and wherein the control circuit can perform a control which turns on the power supply switch connected to at least one of the plurality of memory mats earlier than the power supply switches connected to the other memory mats.

17. The display driver according to claim 16, wherein the control circuit starts the power supply by sequentially turning on the power supply switches connected to each of the plurality of memory mats.

18. The display driver according to claim 16, wherein the control circuit can receive a command supplied from a host processor externally connected to the display driver, and can perform the ON and OFF control of the plurality of power supply switches based on the received command.

19. A display driver comprising:

a driver circuit which can output a driving signal to a display panel externally connected to the display driver;

a memory which is configured to include a plurality of memory mats and can store image data for generating the driving signal;

power supply switches which are connected to each of the plurality of memory mats, and can perform an ON and Off control of power supply to each of the plurality of memory mats; and a control circuit which can perform the ON and Off control of the power supply switch, wherein the control circuit can perform a control which turns on the power supply switch connected to at least one of the plurality of memory mats earlier than the power supply switches connected to the other memory mats, wherein the control circuit can receive a command supplied from a host processor externally connected to the display driver, and can perform the ON and OFF control of the plurality of power supply switches based on the received command, and wherein the control circuit performs a control which starts the power supply to the memory when the command is a command which designates a Command RAM Mode, and performs a control which cuts off the power supply to the memory when the command is a command which designates a Video Through Mode.

20. The display driver according to claim 19, wherein when the command is the command which designates the Command RAM Mode, the control circuit has a function of specifying the memory mat which is a target of the control of turning on the power supply switch earlier than the other memory mats, based on a start address and an end address, which are designated according to the command, of the memory.

* * * * *